US007044810B2

(12) United States Patent
DiTroia et al.

(10) Patent No.: US 7,044,810 B2
(45) Date of Patent: May 16, 2006

(54) ELECTRICAL WEDGE CONNECTOR

(75) Inventors: Gary W. DiTroia, Acworth, GA (US); Mario Tijerina, Col. Algarin (MX); Laurent Guillaumin, Chester, NH (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/118,181

(22) Filed: Apr. 28, 2005

(65) Prior Publication Data

US 2005/0272317 A1 Dec. 8, 2005

Related U.S. Application Data

(60) Provisional application No. 60/577,688, filed on Jun. 7, 2004.

(51) Int. Cl.
*H01R 4/50* (2006.01)

(52) U.S. Cl. ..... 439/783; 439/863

(58) Field of Classification Search ..... 439/783, 439/863
See application file for complete search history.

(56) References Cited

U.S. PATENT DOCUMENTS

| | | | | |
|---|---|---|---|---|
| 3,304,962 | A | 2/1967 | Broske | 140/113 |
| 4,730,087 | A | 3/1988 | Werner | 174/94 |
| 4,915,653 | A * | 4/1990 | Mair | 439/781 |
| 5,090,923 | A | 2/1992 | Kenyon et al. | 439/783 |
| 5,281,173 | A | 1/1994 | Cherry et al. | 439/783 |
| 5,862,589 | A | 1/1999 | Chadbourne et al. | 29/882 |
| 5,868,588 | A | 2/1999 | Chadbourne et al. | 439/783 |
| 6,116,969 | A * | 9/2000 | Piriz | 439/783 |
| 6,120,334 | A | 9/2000 | Timsit et al. | 439/783 |
| 6,322,402 | B1 | 11/2001 | Chadbourne et al. | 439/783 |
| 6,390,861 | B1 | 5/2002 | DeFrance | 439/783 |

* cited by examiner

*Primary Examiner*—Tho D. Ta
(74) *Attorney, Agent, or Firm*—Harrington & Smith, LLP

(57) ABSTRACT

An electrical wedge connector including a connector shell having a general C-shaped cross-section with two opposing free ends, and a wedge. The free ends each comprise an outward extension from the opposing ends. Each outward extension has an outer tip along a longitudinal length of the shell adapted to stablely locate the shell on a surface of a frame of a wedge connector installation tool. The wedge is adapted to wedge two electrical conductors against respective opposing inner sides of the shell.

20 Claims, 5 Drawing Sheets

FIG. 1
PRIOR ART
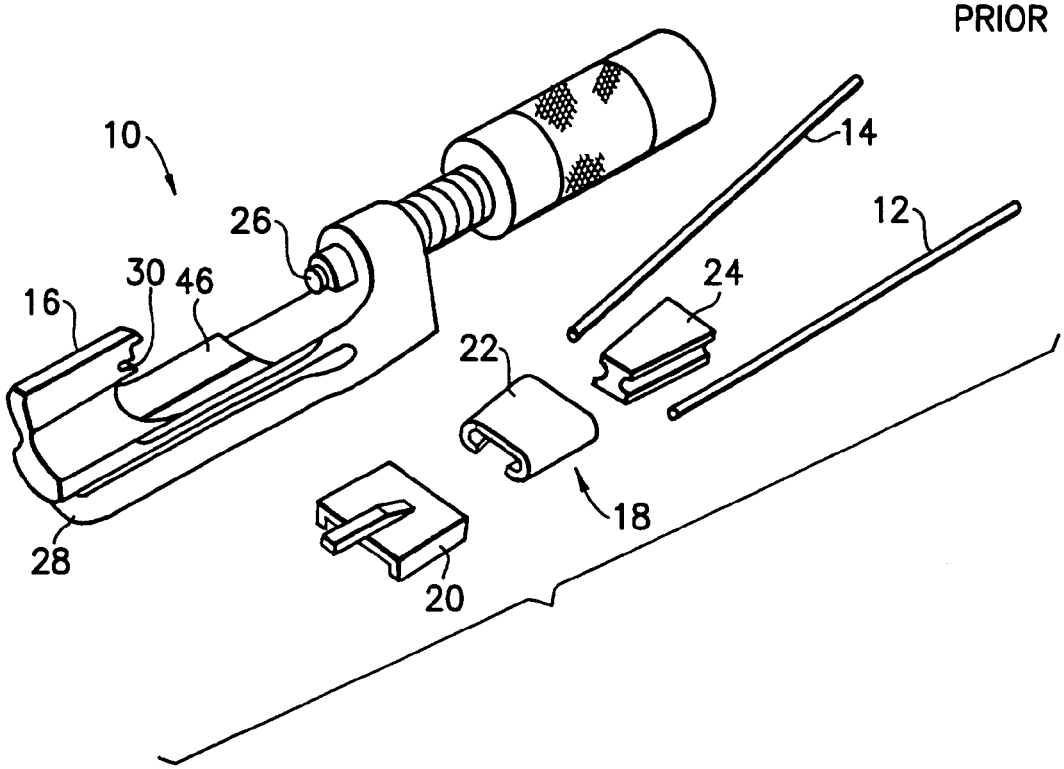
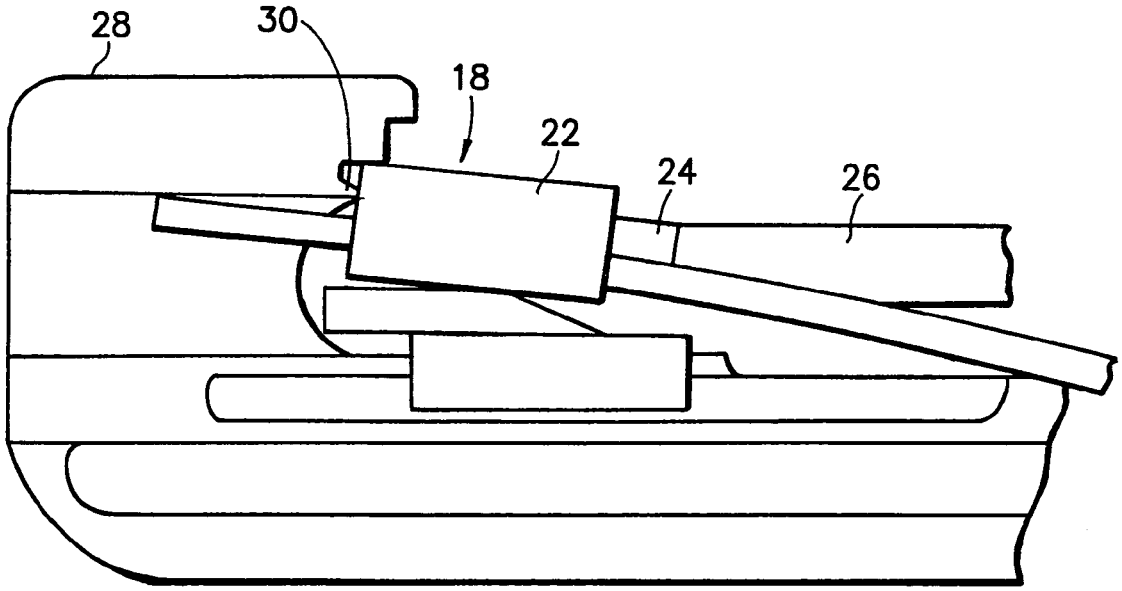
FIG. 2
PRIOR ART

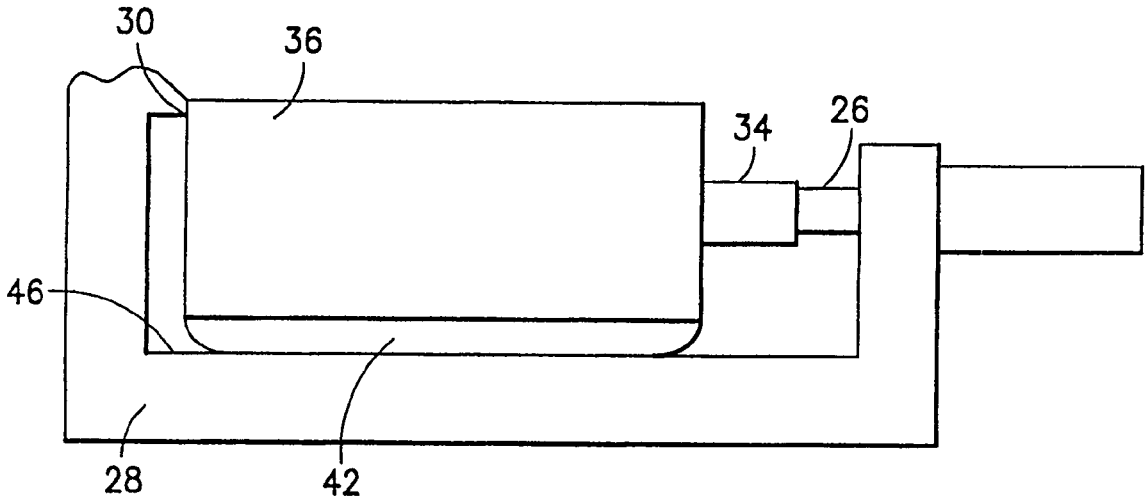
FIG.5
FIG.6
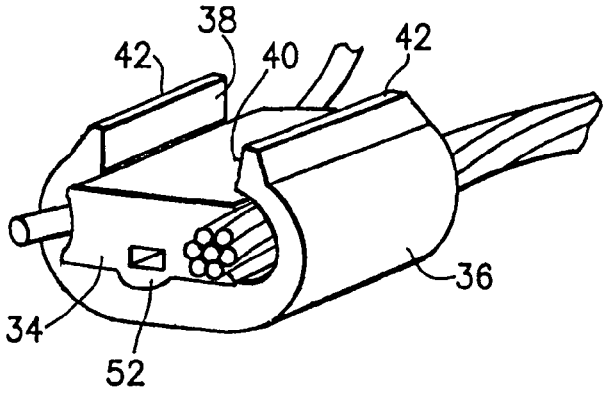

ELECTRICAL WEDGE CONNECTOR

CROSS REFERENCE TO RELATED APPLICATION

This application claims priority under 35 U.S.C. §119(e) to provisional patent application No. 60/577,688 filed Jun. 7, 2004 which is hereby incorporated by reference in its entirety.

BACKGROUND OF THE INVENTION

1. Field of the Invention

The present invention relates to an electrical connector and, more particularly, to a wedge connector.

2. Brief Description of Prior Developments

U.S. Pat. No. 5,868,588 discloses a wedge connector having a wedge with a side which projects out of an open side of the C-shaped shell. Copper wedge connectors are often used to make connections in ground grid networks. A copper wedge connector is designed to provide a reliable system connection. The system consists of Copper wedge connectors, an installation tool such as the WEJTAP™ tool sold by FCI USA, Inc, and a power-booster. Copper wedge connectors use a copper alloy wedge that is power-driven between the main run and the tap cables locking them into a "C" shaped copper alloy spring-body. The spring body maintains consistent pressure throughout the life of connection to ensure reliability during severe electrical and climatic conditions. The wedge's wiping action combined with factory installed contact aid, such as PENETROX™ PEN "E", can provide superior contact integrity. The wedge is automatically locked onto the spring-body by a skiving action produced by a lance at the forward end of the WEJTAP™ installation tool.

In order to install this kind of connector on small wedge connectors, such as WCR-C size connectors sold by FCI USA, Inc., the use of an auxiliary platform is required on the installation tool. This platform is only needed for small connectors. The use of an auxiliary platform involves additional steps during the installation process. During these steps there is a latent risk to make mistakes affecting the final assembly; resulting in defective connections and/or low performance. Present designs available on the market use the platform indicated.

There is a desire to eliminate the need for use of the auxiliary platform when connecting small size wedge connectors. There is a desire to provide a system which can stablely support a wedge connector on an installation tool without use of an auxiliary platform. There is a desire to reduce the steps required to install small size wedge connectors and reduce latent risk to make mistakes affecting the final assembly; resulting in less defective connections and/or less low performance connections.

SUMMARY OF THE INVENTION

In accordance with one aspect of the present invention, an electrical wedge connector is provided including. a connector shell having a general C-shaped cross-section with two opposing free ends, and a wedge. The free ends each comprise an outward extension from the opposing ends. Each outward extension has an outer tip along a longitudinal length of the shell adapted to stablely locate the shell on a surface of a frame of a wedge connector installation tool. The wedge is adapted to wedge two electrical conductors against respective opposing inner sides of the shell.

In accordance with another aspect of the present invention, an electrical wedge connector is provided comprising a connector shell having a general C-shaped cross-section with an opening between two opposing free ends; and a wedge adapted to be inserted into the connector shell to wedge two electrical conductors against respective opposing inner sides of the shell. The wedge comprises a stabilizer runner which projects through the opening and comprises an outer tip along a longitudinal length of the runner which is adapted to stablely locate the wedge on a surface of a frame of a wedge connector installation tool and slide along the surface during insertion of the wedge into the shell by the tool.

In accordance with one method of the present invention, a method of connecting two conductors with an electrical wedge connector is provided comprising inserting the two conductors into a wedge connector shell; inserting a wedge between the two conductors to form a loose assembly; locating the loose assembly in a wedge connector installation tool; and actuating the installation tool to drive the wedge into the shell. A stability runner projecting from a longitudinal length of the shell or the wedge contacts a surface of a frame of the installation tool. The stability runner contacts the surface during a majority of movement of the wedge into the shell by the tool.

BRIEF DESCRIPTION OF THE DRAWINGS

The foregoing aspects and other features of the present invention are explained in the following description, taken in connection with the accompanying drawings, wherein:

FIG. 1 is a perspective view of a wedge connector connection system known in the prior art;

FIG. 2 is a side view of a portion of the connection system shown in FIG. 1 showing use of an auxiliary platform on the installation tool;

FIG. 5 is a side view of the wedge connector shown in FIG. 4 in the installation tool shown in FIG. 1;

FIG. 6 is a perspective view of the wedge connector shown in FIG. 4 attached to two electrical conductors;

DETAILED DESCRIPTION OF THE PREFERRED EMBODIMENTS

Figure 3:
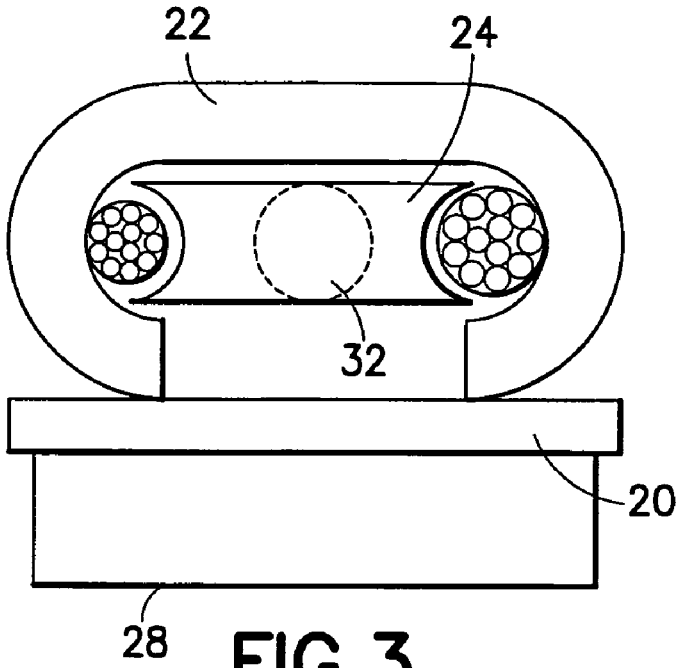
FIG.3 PRIOR ART
FIG. 3 is a cross sectional view of the portion of the connection system shown in FIG. 2.

Referring to FIG. 1, there is shown a perspective view of a conventional wedge connection system 10. The wedge connection system 10 is adapted to connect two electrical conductors 12, 14 mechanically and electrically to each other. The connection system 10 generally comprises a wedge connector installation tool 16 and a wedge connector 18. The wedge connector 18 comprises a shell or connector body 22 and a wedge 24.

The wedge connector 18 is a smaller size wedge connector for connecting smaller size conductors to each other. The shell is sized and shaped to receive the two electrical conductors having a maximum sum of diameters of about 0.7 inch. The shell is sized and shaped to receive the two electrical conductors having a conductor size range of about #8 to 1/0 for a first one of the inner sides (the main run conductor) and about #8 to #2 for a second one of the inner. sides (the tap conductor). The installation tool 16 is adapted to receive a powder cartridge which, when actuated such as by striking the rear end of the installation tool with a hammer, is adapted to drive the ram 26 forward. The installation tool 16 comprises an auxiliary platform 20.

Referring also to FIGS. 2 and 3, the auxiliary platform 20 is used for smaller size wedge connectors to properly position the wedge connectors at a suitable height on the frame 28 of the installation tool to allow the shelf and wedge to contact a lance 30 at the forward end of the installation tool 16 for producing a skiving action which locks the wedge in the shell. The platform 20 is not used for larger size wedge connectors. The platform 20 also elevates the wedge 24 to align the rear end of the wedge 24 with the front of the ram 26 as shown by ram impact area 32 in FIG. 3. As noted above, the use of an auxiliary platform involves additional steps during the installation process. During these steps there is a latent risk to make mistakes affecting the final assembly; resulting in defective connections and/or low performance.

Figure 4:
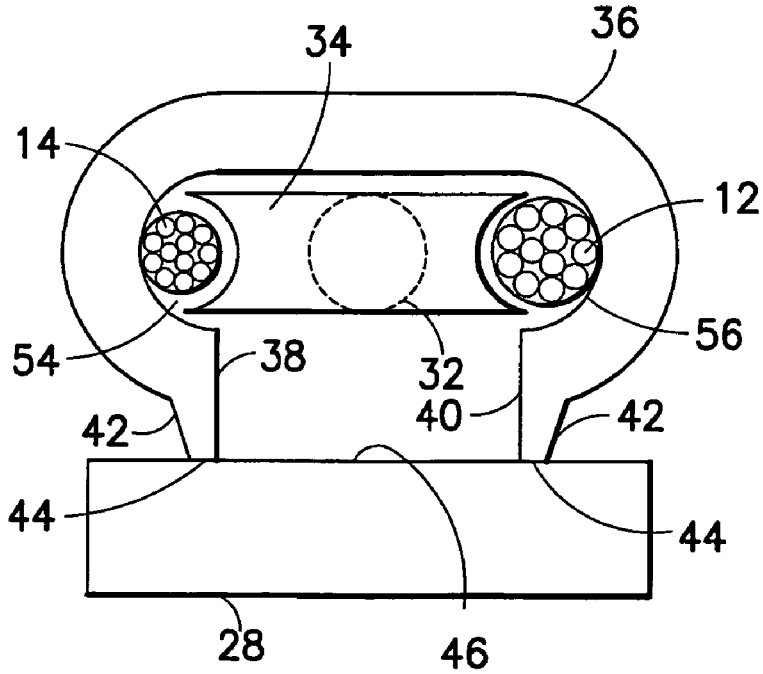
FIG. 4 is a cross sectional view similar to FIG. 3 of a wedge connector incorporating features of the present invention.

Referring now to FIGS. 4–6, one embodiment of the present invention is shown. Although the present invention will be described with reference to the exemplary embodiments shown in the drawings, it should be understood that the present invention can be embodied in many alternate forms of embodiments. In addition, any suitable size, shape or type of elements or materials could be used.

The wedge connection system of the embodiment shown in FIGS. 4–6 comprises the wedge connection tool 16 shown in FIG. 1, but without the auxiliary platform 20. The wedge 34 is the same as the wedge 24 shown in FIGS. 1–3. However, the shell 36 is different from the shell 22. The shell 36 is adapted to connect the same size conductors as the shell 22. In a preferred embodiment, the shell 36 and wedge 34 are comprised of copper. However, any suitable shape and type of material(s) could be used.

This copper wedge connector is manufactured from a high copper alloy casting that is subsequently machined into the final configuration. This connector, based on minor design variations, is capable of accommodating one copper conductor per side getting taps that are currently associated with grounding connection applications. The use of an auxiliary platform is not required. This new design has been selected among other possible options, because it permits a perfect stabilization of the connector on the steel frame tool. This modification will not affect the original electrical or mechanical connector performance, but avoids the utilization of an auxiliary platform; making the installation process easier.

In an alternate embodiment the wedge and shell could be made of any suitable material(s), such as aluminum for example. The wedge is preferably a cast member. The shell is preferably either a cast member or an extruded member. The outward extension(s) or runner tab(s) on the shell could be either at the tips of the "C". shape as depicted in the drawings or anywhere along the downward facing "C" portions (i.e., the side of the shell with the longitudinal opening). In an alternate embodiment multiple runners could be provided (e.g., two skinnier runners) or just elevating "feet" as opposed to a continuous runner.

The wedge 34 is adapted to wedge the two electrical conductors 12, 14 against respective opposing inner sides 54, 56 of the shell 36. The shell 36 has a general C-shaped cross-section with two opposing free ends 38, 40. The free ends 38, 40 each comprise an outward extension 42 from the opposing ends. Each outward extension 42 has an outer tip 44 along a longitudinal length of the shell 36 adapted to stablely locate the shell 36 on a surface 46 of the frame 28 of a wedge connector installation tool 16. The outward extensions 42 form stabilization runners for the wedge connector. These stabilization runners 42 are adapted to stablely located the shell 36 on the surface 46 at a proper location for the lance 30 to be able to lance the wedge 34 and shell 36 together as indicated by deformation 52 in FIG. 6. The outward extensions 42 also elevate the location of the wedge 34 to align the ram impact area 32 with the ram 26. The outward extensions extend along a majority of length of the shell. However, in an alternate embodiment, the outward extensions might not extend along a majority of length of the shell. Three or four outward extensions could be provided for more stability. Little pins would work as well as a complete extension along all the length of both free ends of the shell and may be more cost effective as it will use less material.

The shell is sized and shaped to receive the two electrical conductors having a maximum sum of diameters of about 0.7 inch. The shell is sized and shaped to receive the two electrical conductors having a conductor size range of about #8 to 1/0 for a first one of the inner sides (the main conductor) and about #8 to #2 for a second one of the inner sides (the tap conductor). Thus, the present invention allows a connection of smaller size wedge connectors on the wedge connector installation tool 16 without the use of the auxiliary platform 20. The outward extensions preferably extend along a majority of length of the shell. The wedge connector provides means for allowing the wedge to be properly fully inserted into the shell without use of an auxiliary platform on the wedge connector installation tool. The wedge could comprises a stabilizer runner which projects through the opening and comprises an outer tip along a longitudinal length of the runner which is adapted to stablely locate the wedge on a surface of a frame of a wedge connector installation tool and slide along the surface during insertion of the wedge into the shell by the tool.

The present invention provided features and benefits including:

- High quality connection. Avoiding the use of an auxiliary platform on the installation process provides an easy process preventing mistakes and assuring an optimum connection.
- Lower manufacturing cost. The modification from the casting manufacturing process is relatively inexpensive as compared to the manufacturing of a steel auxiliary platform. Also, the one-piece design requires no secondary assembly operations that increase installation costs.
- Ease of mounting. Having the same conditions for all sizes of this line of connectors facilitate and provide a consistent installation process.

Figure 7:
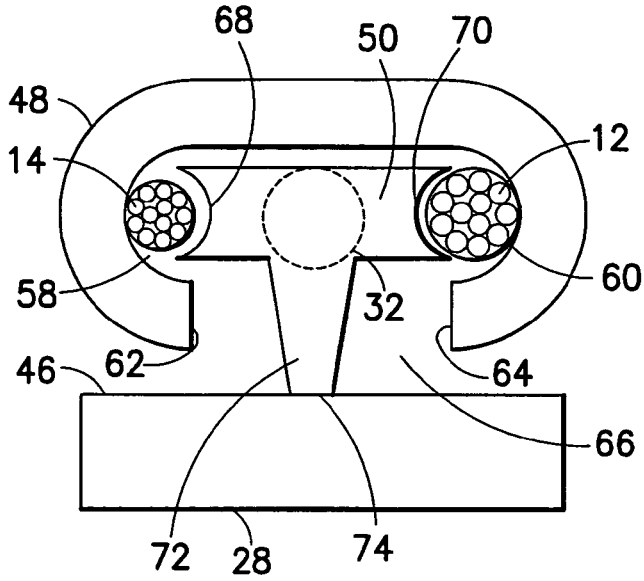
FIG. 7 is a cross sectional view similar to FIG. 4 of an alternate embodiment of a wedge connector incorporating features of the present invention.
Figure 8:
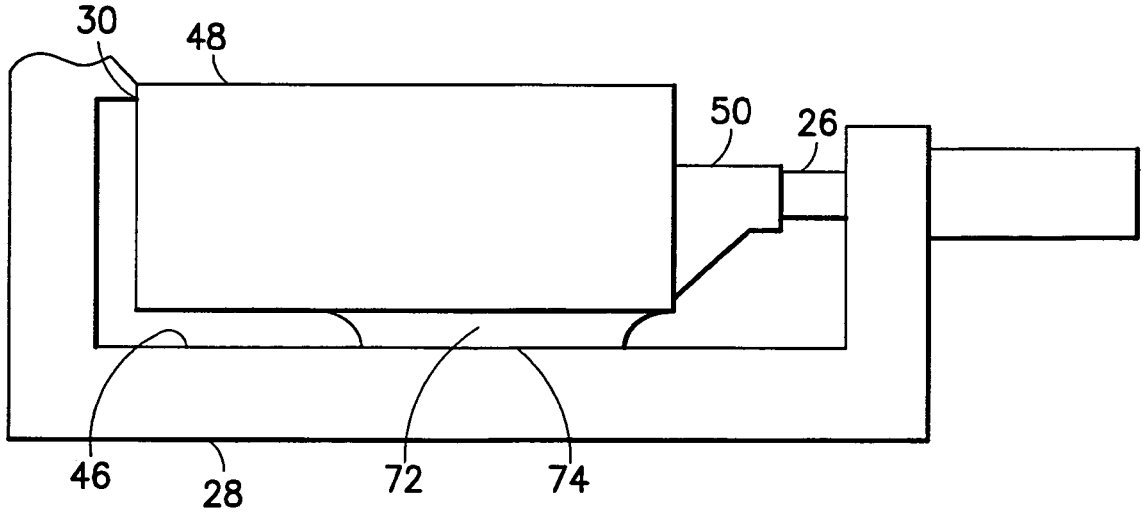
FIG. 8 is a side view of the wedge connector shown in FIG. 7 in the installation tool shown in FIG. 1.
Figure 9:
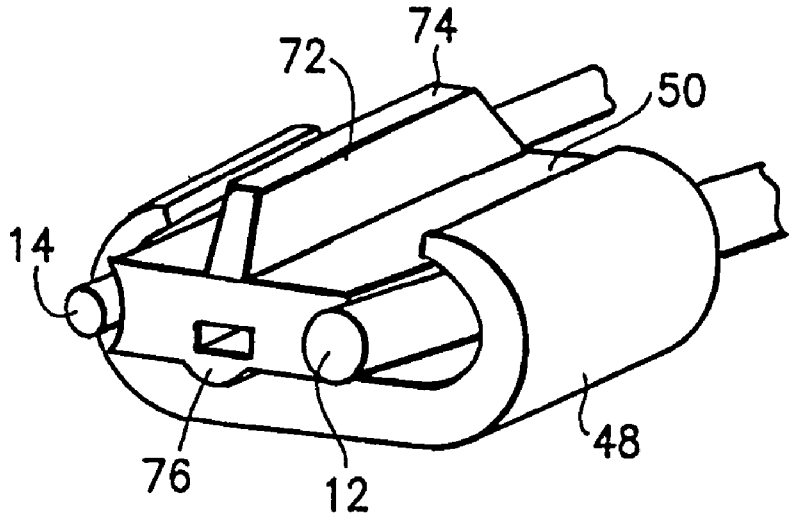
FIG. 9 is a perspective view of the wedge connector shown in FIG. 7 attached to two electrical conductors.

Referring now to FIGS. 7–9, an alternate embodiment of the present invention is shown. The wedge connection system of the embodiment shown in FIGS. 7–9 comprises the wedge connection tool 16 shown in FIG. 1, but without the auxiliary platform 20. The shell 48 is the same as the shell 22 shown in FIGS. 1–3. However, the wedge 50 is different from the wedge 24. The wedge 50 is adapted to wedge the two electrical conductors 12, 14 against respective opposing inner sides 58, 60 of the shell 48. The shell 48 has a general C-shaped cross-section with two opposing free ends 62, 64. An opening 66 is provided between the free ends 62, 64.

The wedge 50 is a one-piece member which comprises a main section having two conductor contact surfaces 68, 70 at opposite sides of the main section. The wedge 50 is adapted to be inserted into the connector shell to wedge the two electrical conductors against respective opposing inner sides of the shell. The wedge 50 also comprises a stabilizer runner 72 which projects through the opening 66. The stabilizer runner 72 comprises an outer tip 74 along a longitudinal length of the runner which is adapted to stablely locate the wedge on the surface 46 of the frame 28 of the wedge connector installation tool 16. The outer tip 74 is adapted to slide along the surface 46 during insertion of the wedge 50 into the shell 48 by the tool 16.

The stabilization runner 72 is adapted to stablely located the shell 48 on the surface 46 at a proper location for the lance 30 to be able to lance the wedge 50 and shell 48 together as indicated by deformation 76 in FIG. 9. The runner 72 also elevates the location of the wedge 50 and the shell 48 to align the ram impact area 32 with the ram 26. Thus, the present invention allows a connection of smaller size wedge connectors on the wedge connector installation tool 16 without the use of the auxiliary platform 20. In an alternate embodiment, the wedge connector could comprise the wedge 50 and the shell 36.

A method of connecting two conductors with an electrical wedge connector can be provided comprising inserting the two conductors into a wedge connector shell; inserting a wedge between the two conductors to form a loose assembly; locating the loose assembly in a wedge connector installation tool; and actuating the installation tool to drive the wedge into the shell. A stability runner projecting from a longitudinal length of the shell or the wedge contacts a surface of a frame of the installation tool. The stability runner contacts the surface during a majority of movement of the wedge into the shell by the tool. The shell can comprise the stability runner, and during actuating of the installation tool the stability runner can remain against the surface of the frame. The wedge can comprise the stability runner, and during actuating of the installation tool the stability runner can slide along the surface of the frame. With the invention, an electrical wedge connector can be provided comprising a wedge comprises a stabilizer runner which projects through the opening and comprises an outer tip along a longitudinal length of the runner which is adapted to stablely locate the wedge on a surface of a frame of a wedge connector installation tool and slide along the surface during insertion of the wedge into the shell by the tool; and the free ends of the shell each can comprise an outward extension from the opposing ends, each outward extension having an outer tip along a longitudinal length of the shell adapted to stablely locate the shell on a surface of a frame of the wedge connector installation tool.

With the present invention, the invention can be thought of as more than just the addition of spacer arms on the connector. It is actually the elevation of the connector in the installation tool by way of a change in the connector's own shape/form/material arrangement.

In an alternate embodiment, the installation tool could have folding sidewalls that raise and lower to raise or lower the connector. Plastic spacer arms could be provided that are separable from the connector after connection. However, these alternative solutions might not eliminate the risk of error by the installer which the invention shown in the drawings suppresses.

Figure 10:
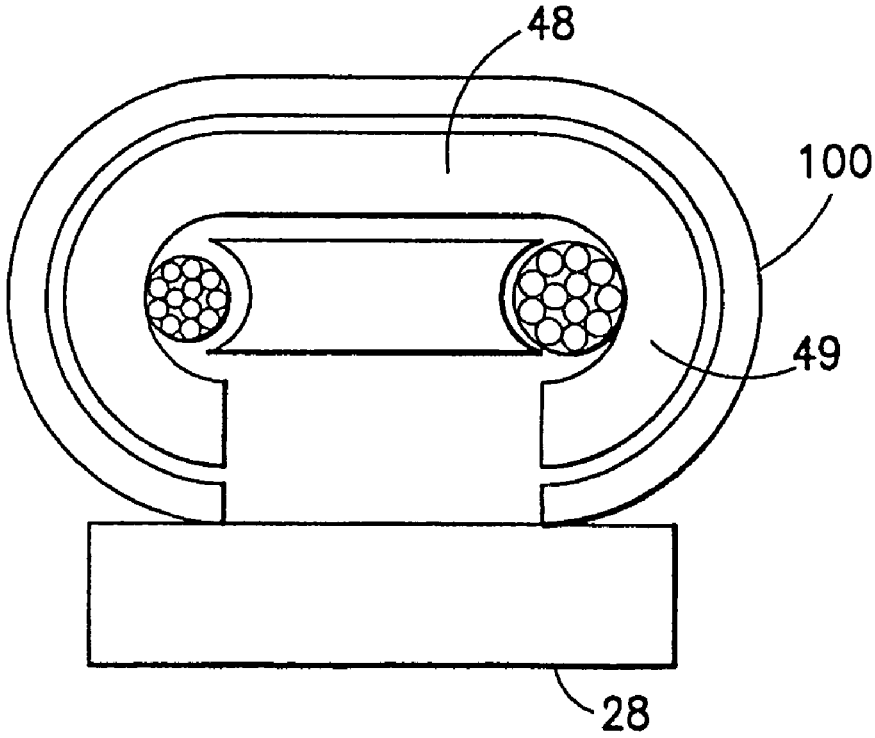
FIG. 10 is an end view of another alternate embodiment of the present invention.

Referring to FIG. 10, a plastic clip 100 mounted on each C body 48 with the same principle as the runners on the C body shown in FIG. 4 could work. The clip would be fixedly, stationarily connected to the main section 49 of the shell 48. The clip 100 could be separable (disposable) after installation, but probably not reusable and would still prevent from risk of errors at the time of installation and save installation time.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical wedge connector comprising:

a connector shell having a general C-shaped cross-section with two opposing free ends, wherein the free ends each comprise an outward extension from the opposing ends, each outward extension having an outer tip aligned along a longitudinal length of the shell adapted to stablely locate the shell on a surface of a frame of a wedge connector installation tool; and a wedge adapted to wedge two electrical conductors against respective opposing inner sides of the shell.

2. An electrical wedge connector as in claim 1 wherein the outward extensions extend along a majority of length of the shell.

3. An electrical wedge connector as in claim 1 further comprising means for allowing the wedge to be properly fully inserted into the shell without use of an auxiliary platform on the wedge connector installation tool.

4. An electrical wedge connector as in claim 1 wherein the wedge comprises a stabilizer runner which projects through the opening and comprises an outer tip along a longitudinal length of the runner which is adapted to stablely locate the wedge on a surface of a frame of a wedge connector installation tool and slide along the surface during insertion of the wedge into the shell by the tool.

5. An electrical wedge connector as in claim 1 wherein the shell is sized and shaped to receive the two electrical conductors having a maximum sum of diameters of about 0.7 inch.

6. An electrical wedge connector as in claim 1 wherein the shell is sized and shaped to receive the two electrical conductors having a conductor size range of about #8 to 1/0, for a first one of the inner sides and about #8 to #2 for a second one of the inner sides.

7. An electrical wedge connector as in claim 1 wherein the outward extensions comprise at least one member fixedly attached to a main section of the connector shell.

8. An electrical wedge connector as in claim 1 wherein the at least one member is removably connected to the main section of the connector shell.

9. An electrical wedge connector comprising:

a connector shell having a general C-shaped cross-section with an opening between two opposing free ends; and a wedge adapted to be inserted into the connector shell to wedge two electrical conductors against respective opposing inner sides of the shell, wherein the wedge comprises a stabilizer runner which projects through the opening and comprises an outer tip along a longitudinal length of the runner which is adapted to stablely locate the wedge on a surface of a frame of a wedge connector installation tool and slide along the surface during insertion of the wedge into the shell by the tool.

10. An electrical wedge connector as in claim 9 wherein the stabilizer runner extends along a majority of length of the wedge.

11. An electrical wedge connector as in claim 9 further comprising means for allowing the wedge to be properly fully inserted into the shell without use of an auxiliary platform on the wedge connector installation tool.

12. An electrical wedge connector as in claim 9 wherein the free ends of the shell each comprise an outward extension from the opposing ends, each outward extension having an outer tip along a longitudinal length of the shell adapted to stablely locate the shell on a surface of a frame of the wedge connector installation tool.

13. An electrical wedge connector as in claim 9 wherein the shell is sized and shaped to receive the two electrical conductors having a maximum sum of diameters of about 0.7 inch.

14. An electrical wedge connector as in claim 9 wherein the shell is sized and shaped to receive the two electrical conductors having a conductor size range of about #8 to 1/0 for a first one of the inner sides and about #8 to #2 for a second one of the inner sides.

15. A method of connecting two conductors with an electrical wedge connector comprising:

inserting the two conductors into a wedge connector shell;

inserting a wedge between the two conductors to form a loose assembly;

locating the loose assembly in a wedge connector installation tool, wherein a stability runner projecting from a longitudinal side of the shell and/or the wedge contacts a surface of a frame of the installation tool; and actuating the installation tool to drive the wedge into the shell, wherein the stability runner contacts the surface during a majority of movement of the wedge into the shell by the tool.

16. A method as in claim 15 wherein the shell comprises the stability runner, and during actuating of the installation tool the stability runner remains against the surface of the frame.

17. A method as in claim 15 wherein the wedge comprises the stability runner, and during actuating of the installation tool the stability runner slides along the surface of the frame.

18. A method as in claim 15 further comprising fixedly connecting at least one member to a main section of the shell, wherein the at least one member forms the stability runner.

19. A method of connecting two conductors with an electrical wedge connector comprising:

inserting the two conductors into a wedge connector shell;

inserting a wedge between the two conductors to form a loose assembly;

locating the loose assembly in a wedge connector installation tool, wherein a stability runner projecting from a longitudinal length of the shell and/or the wedge contacts a surface of a frame of the installation tool;

actuating the installation tool to drive the wedge into the shell, wherein the stability runner contacts the surface during a majority of movement of the wedge into the shell by the tool; and removing the at least one member from the main section of the shell after actuation of the installation tool.

20. An electrical wedge connector comprising:

a connector shell having a general C-shaped cross-section with two opposing free ends, wherein the free ends each comprise at least one outward extension from the opposing ends, each outward extension having an outer tip adapted to stablely locate the shell on a surface of a frame of a wedge connector installation tool; and a wedge adapted to wedge two electrical conductors against respective opposing inner sides of the shell.

* * * * *